United States Patent [19]

Picco

[11] 4,375,847

[45] Mar. 8, 1983

[54] PORTABLE GOLF EQUIPMENT CASE

[76] Inventor: William A. Picco, 12433 Surrey Circle Dr., Tantallon, Md. 20022

[21] Appl. No.: 285,480

[22] Filed: Jul. 21, 1981

[51] Int. Cl.[3] ..... B65D 71/00

[52] U.S. Cl. ..... 206/315 R; 190/18 R; 224/202

[58] Field of Search ..... 224/151; 206/315 R; 190/18 A, 18 R; D3/30, 71; 224/202

[56] References Cited

U.S. PATENT DOCUMENTS

| | | | |
|---|---|---|---|
| D. 261,572 | 11/1981 | Pelavin et al. | D3/71 |
| 3,163,268 | 12/1964 | Leavell | 190/18 A |
| 3,316,951 | 5/1967 | Jacobson | 224/151 X |
| 4,091,977 | 5/1978 | Luttbeg | 206/315 R |

*Primary Examiner*—Steven M. Pollard
*Assistant Examiner*—D. Voorhees
*Attorney, Agent, or Firm*—Brady, O'Boyle & Gates

[57] ABSTRACT

A portable golf equipment case for carrying a knock-down golf bag, clubs, and golf accessories comprising an oblong box-like structure having broad side walls generally in the shape of a parallelogram and including a body portion and a hinged lid forming a major portion of one of the broad side walls. A roller member is located at one diagonal end of the parallelogram type structure with the roller running substantially across the width of the relatively narrow side and end walls to provide a relatively wide load bearing surface for pulling the case from the opposite diagonal end of the structure which includes a flush mounted handle. A second flush mounted handle is located substantially at the mid section of one side wall for lifting and carrying the case. Means are also selectively located on the side wall containing the flush handle for attaching a carrying strap thereto.

11 Claims, 6 Drawing Figures

FIG.1
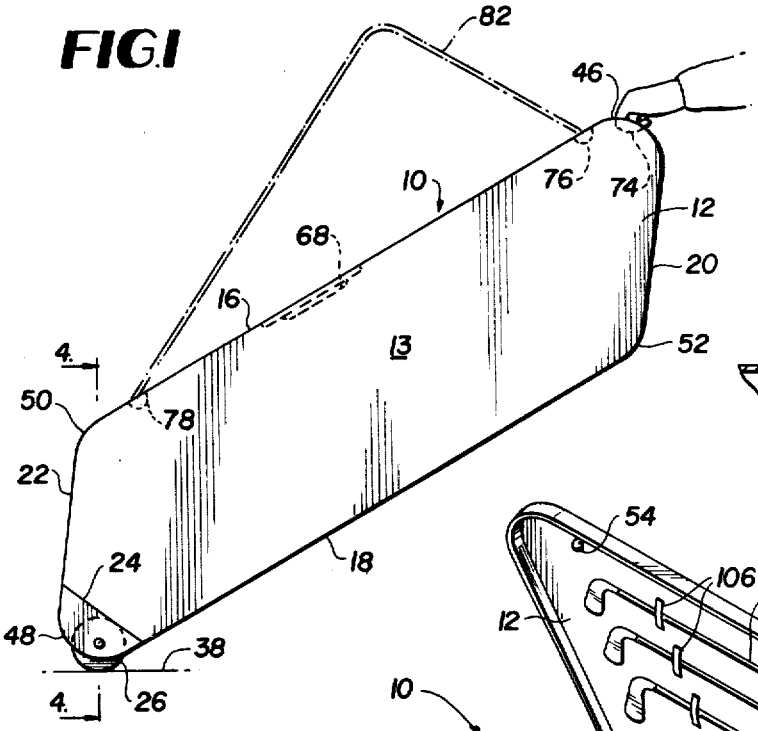
FIG.5
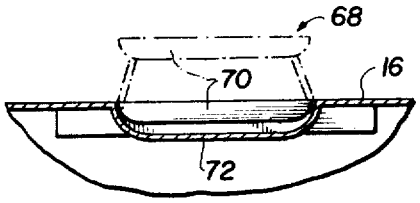
FIG.2
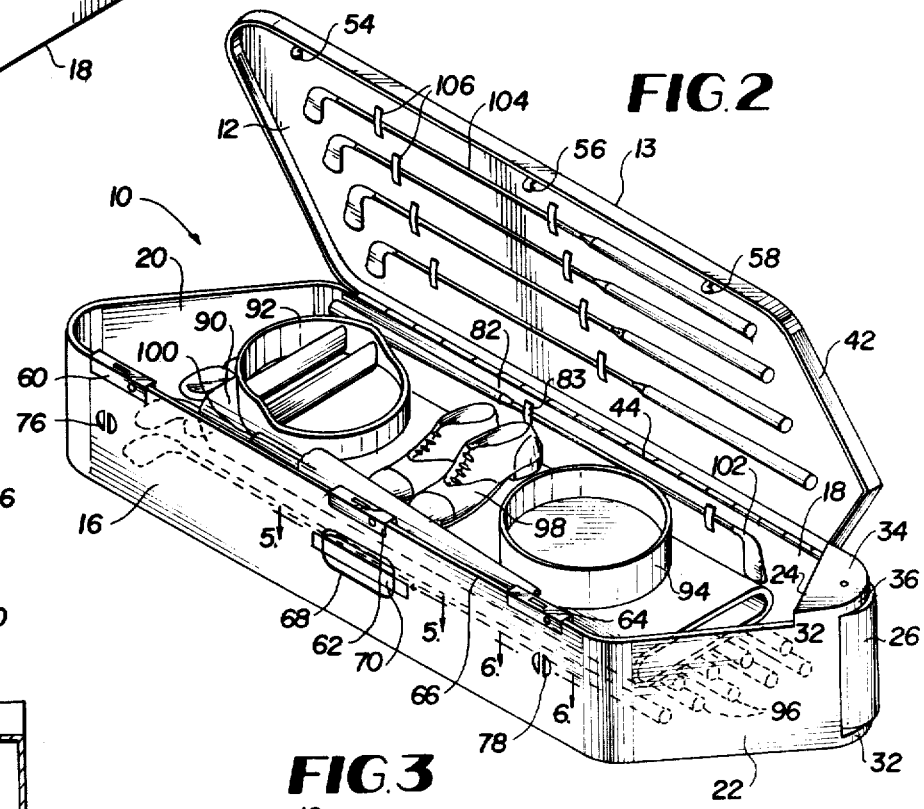
FIG.6
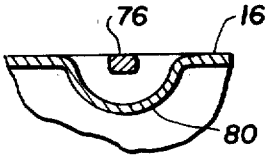
FIG.3
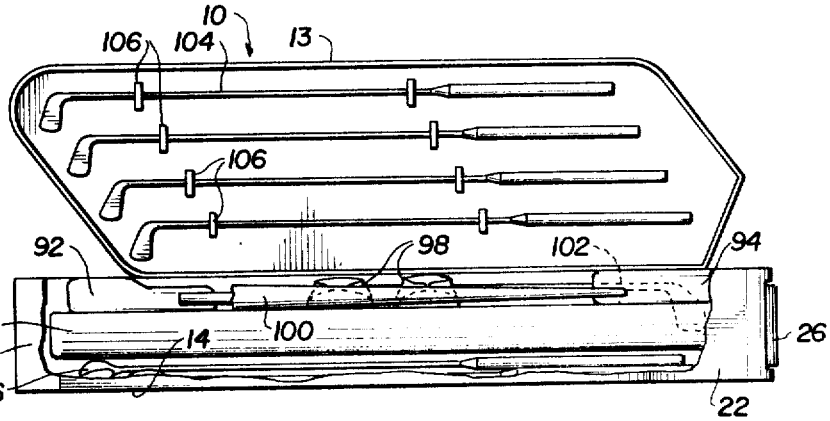
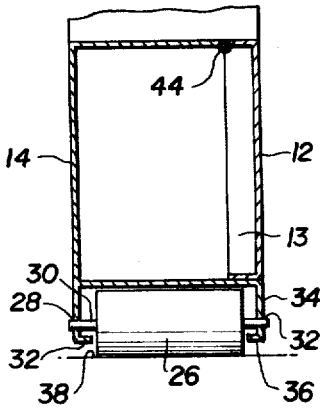
FIG.4

PORTABLE GOLF EQUIPMENT CASE

BACKGROUND OF THE INVENTION

This invention relates generally to means for transporting gold equipment and more particularly to a golf equipment case which is adapted to receive and hold a golf bag in knock-down form as well as the clubs and accessories for playing the game of golf.

The means for protecting a golf bag and its contents during travel generally consists in the utilization of a "travel bag" which is an oversized flexible zippered bag type enclosure into which the golf bag is placed and thereafter securely closed so that the golf bag and its contents are not damaged during transport, particularly during airline travel. More recently a more rigid structure has been proposed somewhat resembling an oversized golf bag which is separable or otherwise open for receiving the golf bag. In either case, the golf bag and its accessories are transported in bulk thereby providing a relatively large and clumsy piece of equipment which can provide a golfer an undue amount of anguish during travel.

In an effort to provide the traveling golfer with equipment that can be easily transported, various types of ingenious constructions have been resorted to including, for example, a knock-down construction of a golf bag shown and described in U.S. Pat. No. 3,901,299 issued to the subject inventor on Aug. 26, 1975. As taught in this patent, a golf bag including a pliable bag body and substantially rigid collar and base members are readily detachable and reattachable from the body so that the golf bag can be transported in a compressed state by being compacted lengthwise to reduce the volume and thereby minimize space requirements. At the desired destination, the collar and base members are reattached for normal use. Such an arrangement is particularly useful where multiple sets of golf clubs are desired to be transported in a trunk of an automobile along with other luggage; however, it does not lend itself to use where public transportation is the mode of travel.

Accordingly, it is an object of the present invention to provide a means for transporting a knock-down golf bag as well as the golf clubs and accessories for the playing of the game of golf.

Another object of the present invention is to provide a means for transporting golf equipment which can be rolled or carried.

Still another object of the present invention is to provide a means for transporting golf equipment in a manner which reduces both bulk and volume during transportation and/or storage.

SUMMARY

These and other objects are accomplished by means of a portable golf equipment case for carrying a knock-down golf bag, clubs and golf accessories therefor comprising an oblong box-like body member having a pair of opposing broad side walls in the shape of a parallelogram separated by pairs of mutually parallel relatively narrow side and end walls with a hinged lid forming the major portion of one broad side wall. A roller member located at one diagonal end of the broad side walls at the apex thereof, said roller running substantially across the width of the side and end walls to provide a relatively wide load bearing surface member for pulling the case from the opposite diagonal end. Means are included at the opposite diagonal end for pulling the case as well as means located substantially at the mid-section of one side wall for lifting and carrying the case. Means are also located substantially at the ends of said side wall for attaching a carrying strap thereto.

BRIEF DESCRIPTION OF THE DRAWINGS

FIG. 1 is a side planar view of a preferred embodiment of the subject invention being pulled over a rolling surface;

FIG. 2 is a perspective view of the preferred embodiment of the subject invention with the lid thereof opened;

FIG. 3 is a bottom elevational view of the embodiment shown in FIG. 2 with the lid thereof opened;

FIG. 4 is a sectional view of the embodiment shown in FIG. 1 taken along the lines 4—4 thereof;

FIG. 5 is a sectional view of the embodiment shown in FIG. 2 taken along the lines 5—5; and FIG. 6 is a sectional view of the embodiment shown in FIG. 2 taken along the lines 6—6.

DESCRIPTION OF THE PREFERRED EMBODIMENT

Referring now to the drawings, FIG. 1 is generally illustrative of the profile of a portable golf equipment case 10 in accordance with the subject invention, the details of which are further disclosed in FIGS. 2 and 3. Reference numeral 12 denotes one of two broad side walls 12 and 14 generally in the form of a parallelogram having rounded corners. The major portion of the broad wall 12 comprises a hinged lid 13. The broad walls 12 and 14 are bounded by relatively narrow top and bottom side walls 16 and 18 as well as forwad and rear end walls 20 and 22.

A relatively short transverse side wall 24 is formed at one end of the structure between the lower portion of the bottom side wall 18 and the lower portion of the rear end wall 22 as shown in FIG. 1 with a roller member 26 spanning the width of the side and end wall dimensions as shown in FIG. 4 while being sealed off from the interior of the case. The bottom side wall 14 extends beyond the transverse side wall 24 as shown in FIG. 4 and includes a rounded extremity including an opening 28 for accepting the axle 30 of the roller 26 therein. Additionally, the extremity of the wall 14 is formed into an inwardly projecting flange 32. On the opposite side of the roller, the transverse wall 24 is extended downwardly into a side wall portion 34 which forms a small extension of the side wall 12 and which includes a mounting hole 32 for the roller axle 30 and a lower flange portion 36. Thus the roller is substantially covered by a cowling type of enclosure except for a lower portion which is adapted to ride on a surface 38 when pulled as shown in FIG. 1 from the opposite end.

As noted the major portion of the broad side wall 12 comprises a lid 13. The lid includes an encircling marginal flange 42 which is hinged along the upper edge of the bottom or rear side wall 18 by means of elongated hinge assembly 44. The marginal flange 42 is adapted to meet the inner edges of the opposing side wall 16 as well as the end wall 20 and a portion of the end wall 22 while becoming flush with the transverse side wall 24. Thus the lid 13 when closed provides an oblong box-like structure whose broad side wall 12 and adjacent wall surface 34 together with the opposite broad side wall 14 describe respective parallelograms having rounded corners with one pair of mutually opposite diagonal end corners 46 and 48 having a relatively larger radius than the other pair of mutually diagonal end corners 50 and 52 as shown in FIG. 1.

As shown in FIG. 2, the marginal flange 42 includes an upper or forward flange portion 52 which includes three projecting members 54, 56 and 58 which are adapted to engage respective lock latch mechanisms 60, 62 and 64 which are mounted on the upper edge 66 of the top or forward end wall 16, thus providing multiple means for providing a triple locked enclosure.

In order that the case can be manually lifted, a flush mounted handle 68 is mounted lengthwise at the mid-section of the top side wall 16 adjacent the latch mechanism 62. The handle 68 assembly preferably includes a hand-grip member 70 such as shown in FIG. 5 which normally fits flush with the top side wall 16 by being located in a recess 72 but when grabbed manually will raise upwardly and outwardly from the top side wall 16 so that it may be gripped properly and thereafter returned to its recessed state. In order that the case can be pulled as shown in FIG. 1, a second flush mounted handle assembly 74 is located in the rounded corner 46 between the top side wall 16 and the forward end wall 20 but being oriented transversely with respect to the broad side walls 12 and 14 so that it may be easily gripped for pulling. In addition to the handles 68 and 74, there are included two identical flush mounted attachment bars 76 and 78, one of which is shown in detail in FIG. 6. The bar 76, for example, spans an underlying recess 80 formed in the top side wall 16. The purpose of the two attachment bars 76 and 78 is to accommodate the connection of a carrying strap 82 shown in the phantom view in FIG. 1 whereby one can carry the case, in the same manner as a golf bag or utilize the same for dragging the case in a rolling manner across the surface 38. Thus three modes of transporting the case 10 are provided, depending upon the desires of the user.

The case 10 is particularly adapted to accommodate a knock-down golf bag such as shown and described in the above referenced Picco patent U.S. Pat. No. 3,901,299, the teachings of which are intended to be incorporated herein by reference. The construction of such a bag includes a pliable bag body 90 which is detachable from an upper collar member 92 and a bottom pan member 94. The interior of the casing 10 is dimensioned so that it is adapted due to the angulated end walls 20 and 22 to accommodate a set of golf clubs of varying lengths and types, i.e. woods and irons as well as other golf accessories.

The arrangement shown in FIGS. 2 and 3 discloses the bag body 90 in a collapsed state overlying a portion 96 of a golf club set. On top of the collapsed bag body 90 is located the collar 92 and the pan 94 which also leaves space, for example, for a pair of golf shoes 98 and an umbrella 100. Additionally, the inside surface of the bottom side wall 18 includes retaining means 83 e.g. clips or straps for holding a single gold club 102 thereat, said golf club comprising, for example, a putter. The lid 40 additionally due to the space provided by the marginal flange 42 and the substantially parallelogram shape of the lid it is adapted to accommodate, for example, four clubs 104 of a golf club set on the inner surface thereof by being secured by retaining means 106.

Thus when the lid 13 is closed, a complete set of golf clubs together with an unassembled golf bag and related accessories for the playing of golf can be transported either by carrying or rolling and upon arriving at the destination the golf bag can be quickly reassembled and used in the normal manner in accordance with the teachings of U.S. Pat. No. 3,901,299. When desirable, the strap 82 shown in FIG. 1 can be the same strap normally associated with and attached to the golf bag body 90 merely with the proper adaption of connecting means between the bag body and the posts 76 and 78.

Having thus shown and described which is at present considered to be the preferred embodiment of the subject invention, it should be noted that the aforementioned detailed description has been made by way of illustration and not of limitation and accordingly all modifications, alterations and changes coming within the spirit and scope of the invention is herein meant to be included.

I claim as my invention:

1. A portable golf equipment case for carrying a knock-down golf bag, clubs and golf accessories comprising in combination:

an oblong box-like body member including a pair of broad side walls generally in the form of a parallelogram and connected by a pair of relatively narrow side walls and a pair of relatively narrow end walls, one of said broad walls having a major portion thereof forming a lid for entry into the interior of said body member;

a roller member located at one diagonal end of said case, said roller member running substantially across the width of said relatively narrow side and end walls for providing a relatively wide load bearing surface for pulling the case from the mutually opposite diagonal end;

means located at said opposite diagonal end for pulling said case;

means located substantially at the mid section of one narrow side wall for lifting and carrying said case; and means selectively located on said one side wall for attaching a carrying strap thereto.

2. A portable golf equipment case as defined in claim 1 wherein said pair of broad side walls are generally in the shape of a parallelogram having rounded corners and wherein said side and end walls meet in a rounded wall transition conforming to the corners of said parallelogram.

3. The portable golf equipment case as defined by claim 2 wherein said lid is hingedly attached to one of said relatively narrow side walls and wherein the remainder of said one broad side wall comprises mounting means for said roller member.

4. The portable equipment case as defined by claim 3 and additionally including a relatively short transverse side wall located adjacent said roller member between a mutually converging narrow side wall and end wall of said pairs of relatively narrow side and end walls.

5. The portable golf equipment case as defined by claim 4 wherein said mutualy converging side and end wall as well as a pair of broad side walls extend beyond said transverse side wall to provide a protective enclosure for said roller member.

6. The portable golf equipment case as defined by claim 3 wherein said lid includes an encircling marginal flange member for providing a relatively shallow interior space whereupon one or more golf clubs can be secured to the inner surface of said lid.

7. The golf equipment case as defined by claim 6 wherein the inside surface of said lid includes means for mounting one or more golf clubs thereat and wherein the inside surface of one relatively narrow side wall includes means for mounting at least one golf club thereat and wherein the remainder of said golf clubs as well as a knock-down golf bag and accessories for playing the game of golf are located in the remaining interior spaced of said body member.

8. The portable golf equipment case as defined by claim 2 wherein said means at said opposite diagonal end for pulling said case comprises a flush mounted handle assembly running transverse to said pair of broad side walls.

9. The portable golf equipment case as defined by claim 2 wherein said means for lifting and carrying said case comprises a flush mounted handle assembly running longitudinally with respect to said one narrow side wall.

10. The portable golf equipment case as defined by claim 9 wherein said means for attaching a carrying strap thereto comprises a pair of flush mounted attachment bars located on said one narrow side wall on opposite sides of said flush mounted handle assembly.

11. The portable golf equipment case as defined by claim 2 and including locking means for locking said lid to one side wall.

* * * * *